United States Patent [19]

McCoy

[11] Patent Number: 4,874,910

[45] Date of Patent: Oct. 17, 1989

[54] HIGH LEAD DENSITY VACUUM FEEDTHROUGH

[75] Inventor: Joseph R. McCoy, Frankfort, N.Y.

[73] Assignee: Government of the United States as represented by the Secretary of the Air Force, Washington, D.C.

[21] Appl. No.: 184,678

[22] Filed: Apr. 22, 1988

[51] Int. Cl.[4] ..... H01B 17/26

[52] U.S. Cl. ..... 174/152 GM; 174/50.56

[58] Field of Search ..... 174/50.5, 50.56, 50.58, 174/50.6, 50.61, 50.63, 52 H, 152 GM; 437/214, 221, 223; 439/935

[56] References Cited

U.S. PATENT DOCUMENTS

| | | | |
|---|---|---|---|
| 2,900,584 | 8/1959 | Bottom | 437/223 X |
| 3,109,054 | 10/1963 | Kuhnapfel et al. | 174/152 GM |
| 3,219,753 | 11/1965 | Vassos | 174/152 GM |
| 3,539,704 | 11/1970 | Sator et al. | 174/50.56 X |
| 3,636,235 | 1/1972 | Williams | 174/52 HX |
| 4,103,416 | 8/1978 | Sakamoto | 174/152 GM X |
| 4,507,522 | 3/1985 | Kyle | 174/152 GM |

FOREIGN PATENT DOCUMENTS

| | | | |
|---|---|---|---|
| 1180738 | 1/1959 | France | 174/152 GM |
| 13133664 | 11/1962 | France | 174/52 H |
| 699492 | 11/1953 | United Kingdom | 174/152 GM |

*Primary Examiner*—Laramie E. Askin

*Attorney, Agent, or Firm*—Bernard E. Franz; Donald J. Singer

[57] ABSTRACT

A vacuum feedthrough includes a metal case having elongated, closely spaced, parallel sidewalls and short, conjoining endwalls with a plurality of leads extending through the case open interior; the leads being arranged in closely spaced, parallel, side-by-side relation to and equi-distant between the sidewalls. A hermetic glass seal is created in the case interior in bonded relation with the plural leads and the case walls.

3 Claims, 1 Drawing Sheet

HIGH LEAD DENSITY VACUUM FEEDTHROUGH

BACKGROUND OF THE INVENTION

The present invention relates to electrical feedthrough devices and particularly to a multiple-lead electrical feedthrough device for conveying signals to and from electrical components enclosed in an evacuated vessel or enclosure.

There are numerous applications where it is necessary to penetrate an evacuated enclosure with a multiplicity of electrical leads so as to provide signal access to electrical components contained therein. One such application for which the present invention has particular but not limited utility is in infrared detector assemblies. Such assemblies include a vacuum enclosure in which are contained a multiplicity of detector elements and associated circuitry and components whose signal responses must be brought out via leads or feedthroughs hermetically penetrating the enclosure to an external image reconstruction system. These feedthroughs must be extremely impervious to gas penetration so as not to jeopardize the requisite hard vacuum within the enclosure over an extended operating life. Infrared detector assemblies are often subjected to hostile environments during use which may involve extreme temperature variations and physical shock. Matching of the expansion and contraction characteristics of the materials making up the feedthrough is an important consideration if their hermetic character is to be maintained both during the manufacturing process and subsequent use of an infrared detector assembly. Should even a single feedthrough lose its imperviousness to gas penetration into the enclosure or a lead break off or become open-circuited, the detector assembly typically must be scrapped, as multiple-lead feedthroughs have not been readily replaceable.

When dealing with a multiplicity of feedthrough leads, as in the case of infrared detector assemblies, it would be highly desirable from a manufacturing standpoint to utilize automated lead welding or soldering equipment to rapidly and reliably effect the numerous electrical joints at the opposed ends of the leads to circuit elements internal and external to the vacuum enclosure. Multiple-lead vacuum feedthroughs are not currently configured such as to lend themselves to such automated lead bonding equipment.

It is accordingly an object of the present invention to provide an improved multiple-lead vacuum feedthrough.

A further object is to provide a vacuum feedthrough of the above-character, wherein the multiple leads are arranged in densely packed relation.

An additional object is to provide a vacuum feedthrough of the above-character, wherein the multiple leads are arranged in a manner readily accommodated by automated lead bonding equipment.

An additional object is to provide a vacuum feedthrough of the above-character, which is structured such as to be readily replaceable without harm to the enclosure to which it is adapted and without prejudice to its hermetic character.

Other objects of the present invention will in part be obvious and in part appear hereinafter.

SUMMARY OF THE INVENTION

In accordance with the present invention there is provided a multiple lead vacuum feedthrough comprising a metal case having elongated, closely spaced, parallel sidewalls joined by short, opposed endwalls. A lead frame, consisting of an array of individual leads held in planar relation at their opposite ends by opposed headers, extends through the open ends of the case and is disposed in parallel relation to and and equally spaced from the sidewalls. An appropriate sealing glass is fused around the individual leads to create a tenacious, hermetic glass-to-metal bond with both the individual leads and the case walls. This glass seal is located at one open end of case and extends to a point well short of the other open end which is integrally equipped with a laterally extending, perimetrical flange facilitating ultimate welding of the vacuum feedthrough to an enclosure. The junctions of the opposed lead ends with the headers are relieved to create weak points facilitating the headers being broken off, leaving the aligned lead ends beyond the case ends available for automated lead bonding.

DETAIL DESCRIPTION

Figure 1:
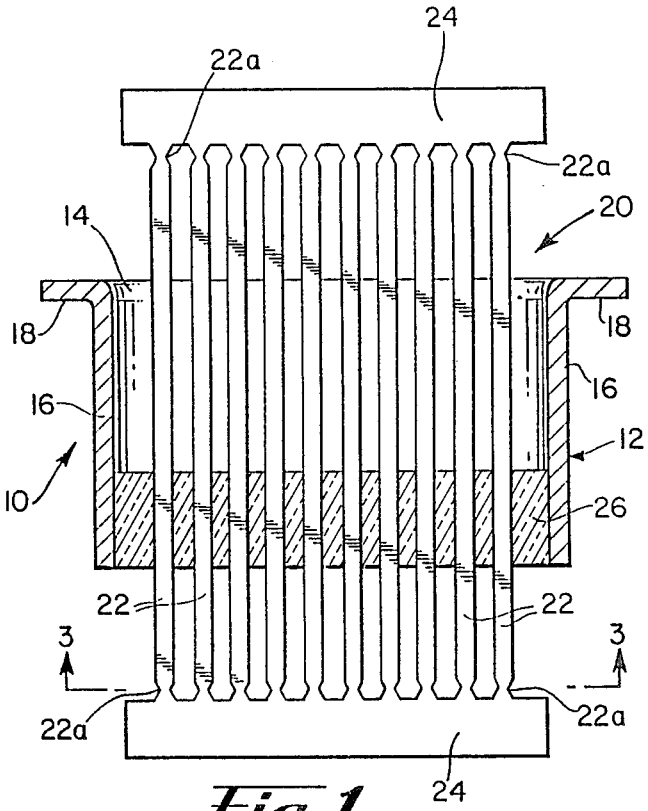
FIG. 1 is a longitudinal sectional view of a multiple lead vacuum feedthrough constructed in accordance with the present invention.
Figure 2:
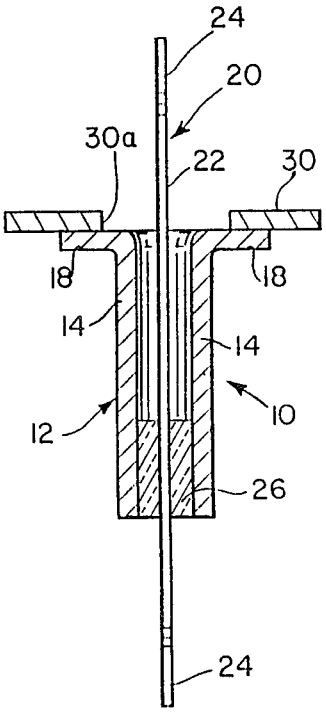
FIG. 2 is a lateral sectional view of the vacuum feedthrough of FIG. 1.
Figure 3:
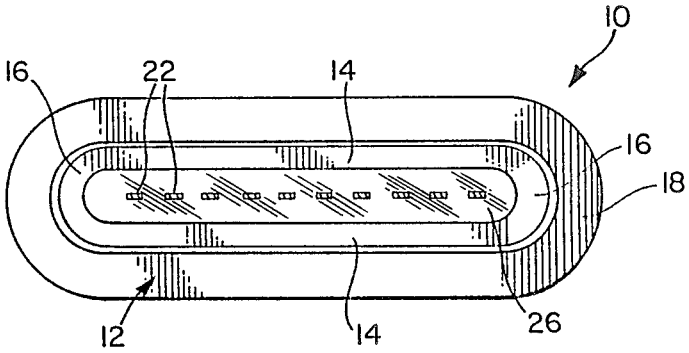
FIG. 3 is a sectional view taken along line 3—3 of FIG. 1.

Referring jointly to FIGS. 1–3, a multiple-lead vacuum feedthrough, constructed in accordance with the present invention and generally indicated at 10, includes a drawn metal case, generally indicated at 12, of oblong oval or racetrack shape having a pair of elongated, straight, relatively closely spaced, parallel sidewalls 14 and opposed, short, semicircular, conjoining endwalls 16. Extending laterally from the illustrated upper end of the case is an integrally formed, continuous, perimetrical flange 18. Positioned within the open interior of case 12 is a conductive metal lead frame, generally indicated at 20, comprising a planar array of individual leads 22 held in aligned, spaced relation at their opposite ends by conjoining headers 24 located beyond the case open ends. This lead frame is formed either by a machining or chemical etching operation performed on a metallic sheet of desired thickness, for example five mils, in the planar pattern seen in FIG. 1 of uniformly spaced, coextensive leads 22 and conjoining headers 24. A suitable lead frame material may be an iron-nickel-cobalt alloy such as KOVAR (a Westinghouse Corporation registered trademark) which has thermal expansion and contraction characteristics matching those of sealing glasses commonly utilized in vacuum feedthroughs. It is therefore preferred that case 12 also be formed of KOVAR.

To sealingly mount lead frame 20 in its extension through the open interior of case 12 with its planar array of leads 22 oriented in parallel, equally spaced relation to case sidewalls 14, as seen in FIG. 2, a suitable glass seal 26, such as Corning 7052 sealing glass, is fused in bonded relation to both the individual leads and to the case walls. This gas impervious seal may be achieved by seating the un langed, open lower end of the case on a suitable graphite fixture (not shown) which serves to substantially close off the lower end of the case and also support lead frame 20 in its illustrated relationship to the case walls. Sealing glass in bead form is introduced to the case interior to a level of approximately one-third to one-half of the height of the case walls. Alternatively, a pair of elongated sealing glass beads or slugs of appropriate dimensions are placed in the spaces between the lead frame and the case sidewalls 14. This assembly is then heated to a temperature sufficient to melt the glass beads or slugs, which then flow into the interstices of the lead frame. The assembly is then cooled down, allowing the glass to fuse into hermetic glass seal 26 tenaciously bonded to the individual leads 22 and also to the case walls. Since the thermal expansion and contraction characteristics of the case and lead frame materials are matched to that of the sealing glass, the hermetic character of glass seal 26 is not jeopardized during this cool down, as well as during any subsequent thermal cycling.

It is seen that the resulting feedthrough provides a multiplicity of leads 22 in spaced, edge-to-edge alignment and all lying in a common plane. As so arranged, the leads are in an ideal configuration for rapid and reliable circuit interconnection using automated lead bonding techniques, such as parallel gap welding, fine diameter wire ball bonding, or wedge bonding. Gold plating may be applied to the leads to inhibit oxidation and to facilitate the lead bonding operation. It is noted from FIG. 1 that the junction of each lead end with headers 24 is relieved, as indicated at 22*a*, to provide weak points facilitating the breaking off or severance of the headers from the lead ends, either before or after the lead bonding operation has been performed.

It should be noted that glass seal 26 occupies approximately the lower third of the case interior, and thus terminates well short of the case flanges which are provided to facilitate welding or brazing feedthrough 10 in position about an opening 30*a* provided in a vacuum enclosure wall 30, as illustrated in FIG. 2. The thermal stresses induced in the flanged end of case 12 during this assembly operation are effectively isolated from glass seal 26, thereby assuring its hermetic character. Should vacuum feedthrough 10 subsequently be found defective due to lead breakage, loss of lead continuity, or loss of its hermetic character, it can readily be replaced by breaking its bond with the enclosure, and welding or brazing a new one in its place, all without harm to the enclosure.

As an example of the lead density achievable in vacuum feedthrough 10 of the present invention, a practical enbodiment thereof has been fabricated with thirty leads 15 mils wide, 5 mils thick and linearly arranged on 20 mil centerlines, leaving an inter-lead gap of 5 mils.

While metal case 12 has been illustrated as being of a racetrack shape, it will be appreciated that it may be rectangular or boxlike in shape. Moreover, while it is preferably that lead frame 20 be formed from metal sheet with integral, breakaway headers 24, the lead frame may be provided as a linear array of individual leads of rectangular or circular cross section with the aligned terminations thereof welded to separate headers.

It is thus seen that the objects set forth above, as well as those made apparent in the preceding description, are efficiently attained, and, since certain changes may be made in the above construction without departing from the scope of the invention, it is intended that all matters contained in the above description or shown in the accompanying drawing shall be interpreted as illustrative and not in a limiting sense.

Having described the invention, what is claimed to secure by Letters Patent is:

1. A vacuum feedthrough comprising, in combination;

a case having an open interior defined by a pair of elongated, closely spaced, parallel sidewalls and short, opposed, conjoining endwalls;

said case including first and second opposed, open ends, said case sidewalls and endwalls at said first end being integrally formed having a laterally offset, continuous, perimetrical flange facilitating feedthrough affixation to a vacuum enclosure;

a plurality of leads extending through said case open interior and having opposed ends extending beyond the opposed open ends of said case, said leads being arranged in closely spaced, parallel, side-by-side relation in a linear array oriented parallel to and equi-distant between said sidewalls;

a hermetic glass seal closing off said case open interior and effecting a lead-to-glass seal, said glass seal being located adjacent said second open end in spaced relation to said first open end of said case so that it occupies the case from said second open end to a fraction of the distance to the first open end;

said plurality of leads being in the form of a lead frame created from a metallic sheet having a planar array of closely spaced, coextensive rectangular leads integrally interconnected at the opposed ends thereof by separate headers. the leads having junctions with the headers at each end which are relieved to create weak points, said headers being severed from said lead ends at said junctions subsequent to the formation of said glass seal.

2. The vacuum feedthrough defined in claim 1, wherein said glass seal occupies said case interior from said second open end to approximately one-third the distance to said first open end.

3. The vacuum feedthrough defined in claim 2, wherein said sidewall conjoining endwalls are of a semicircular shape.

* * * * *

UNITED STATES PATENT AND TRADEMARK OFFICE

CERTIFICATE OF CORRECTION

PATENT NO. : 4,874,910

DATED : October 17, 1989

INVENTOR(S) : Joseph R. McCoy

It is certified that error appears in the above-identified patent and that said Letters Patent is hereby corrected as shown below:

Col 1, line 29, "feedthrough" should be "feedthroughs".

Col 2, line 6, "and" first occurrence should be deleted.

Col 2, line 65, "un langed," should be "unflanged,".

Col 4, claim 1, line 42, "headers. the" should be "headers, the".

Signed and Sealed this

Twenty-second Day of January, 1991

*Attest:*

HARRY F. MANBECK, JR.

*Attesting Officer*

*Commissioner of Patents and Trademarks*